United States Patent [19]

Amirikian

[11] Patent Number: 4,708,081

[45] Date of Patent: Nov. 24, 1987

[54] STABILIZER FOR FLOATING AND SUBMERSIBLE STRUCTURES

[75] Inventor: Arsham Amirikian, 6526 Western Ave., Chevy Chase, Md. 20815

[73] Assignee: Arsham Amirikian, Chevy Chase, Md.

[21] Appl. No.: 868,720

[22] Filed: May 30, 1986

[51] Int. Cl.[4] ..... B63B 21/00

[52] U.S. Cl. ..... 114/230; 114/44; 405/3; 405/4

[58] Field of Search ..... 114/230, 45, 48, 44; 405/3, 4

[56] References Cited

U.S. PATENT DOCUMENTS

| | | | |
|---|---|---|---|
| 1,527,546 | 2/1925 | Engstrand | 114/45 |
| 2,379,685 | 7/1945 | Crandall | 114/45 |
| 2,808,016 | 10/1957 | Jarnot | 114/230 |
| 3,603,276 | 9/1971 | Lisle | 114/45 |
| 3,841,441 | 10/1974 | Klinkhammer et al. | 405/3 |
| 4,432,664 | 2/1984 | Baldyga | 405/3 |

FOREIGN PATENT DOCUMENTS

| | | | |
|---|---|---|---|
| 1029749 | 5/1958 | Fed. Rep. of Germany | 405/3 |
| 2318050 | 10/1973 | Fed. Rep. of Germany | 114/230 |
| 703285 | 4/1931 | France | 114/230 |

*Primary Examiner*—Joseph F. Peters, Jr.
*Assistant Examiner*—Thomas J. Brahan

[57] ABSTRACT

A series of simple detachable frames, fitted between a floating body and its' mooring support structure, will provide static stability to the floating body, by restraining all movements—except those occurring vertically under tides and buoyancy lift, and to which movements it will provide vertical guidance. Called "Stabilizer for Floating and Submersible Structures," many uses are anticipated for the device. Among these are: pontoon lift docks, where it will eliminate the need for winches and their lift cables or chains, as well as their support piers; ocean-bed exploratory structures, where it will create a new type of stabilized oil-drilling platform and transfer shuttle; and for water craft at mooring, a safer securing system to replace conventional mooring lines.

4 Claims, 9 Drawing Figures

STABILIZER FOR FLOATING AND SUBMERSIBLE STRUCTURES

This invention relates to the stability of floating and submersible structures when moored-to or operated alongside a pier or any other lateral support structure.

A free-floating structure with a positive GM (metacentric height), when disturbed by external transient forces due to wind and wave action, goes through a complex pattern of rotational and traversal motions to regain its equilibrium. The frequency and amplitude of these restorative motions vary according to certain physical characteristics of the structure. The tri-axial components in the three principal planes cause the structure to sway by roll and pitch, swing by yaw, move back-and-forth laterally and longitudinally, and rise and fall vertically. Under these motions, the mooring of a floating structure, to secure in position and to minimize impact damage and fatiguing stresses in both moored and support structures and protective piling, has remained a difficult problem to cope with. This is due mainly to the inability of conventional line moorings to provide for the contradictory requirements of tightness and slackness; the former to reduce the amplitude of movements, and the latter to allow for rise-and-fall from tides and surge.

It is one objective of this invention to restrain all rotary and traversal movements of a floating structure at mooring flotation, by replacing conventional flexible mooring lines with a simple structural framing system which, in effect, will eliminate all displacements—except those occurring vertically, to which movements it will provide vertical guidance.

Another and still more important objective is to utilize the same framing device as stabilizer element for a floating submersible structure, such as the dock pontoon described in my U.S. Pat. No. 3,688,719, entitled "Lift Pontoon and Dock," issued Sept. 5, 1972. In that application, the stability in the submerged position is provided by a set of cables suspended from winches mounted on two flanking piers. By the use of the stabilizing device, the winches, cables and support piers will be eliminated from dry dock assembly; and the pontoon will thus become a stable floating dry dock—without wing walls. In effect, then, the simple framing adjunct contemplated by this invention will bring about not only radical changes in dry dock assembly and operational site layout but also a new concept of stability for submersible buoyant structures. For, by the substitution, in lift docks, gone will be the ever-troublesome winches with motors to synchronize, and their adjunct cables or chains—together with associated problems of slackening, corrosion and replacements; and in conventional floating dry docks, the removal of costly and restrictive wing walls. As for stability, for the first time in drydocking history, a hydrostatically unstable structure will be made statically stable through the aid of the stabilizing device of the invention.

DESCRIPTION OF THE PREFERRED EMBODIMENT

Figure 1:
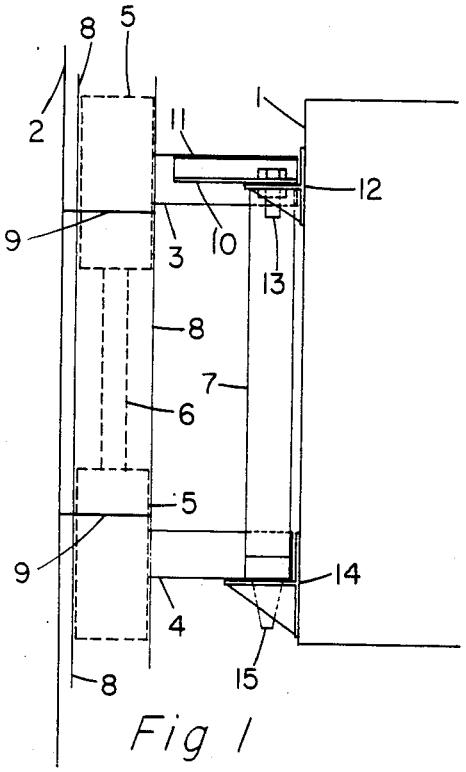
FIG. 1 is a side view of the framing assembly embodying the invention.

The device, which is called "Stabilizer for mooring and submergence of buoyant structures," and referred to simply as "Stabilizer," is shown in FIG. 1, in elevational view, fitted between the inboard face 1 of the dock pontoon and the outboard face 2 of fixed mooring support structure. The basic unit consists of a rectangular rigid frame 16, composed of an upper horizontal arm 3, lower arm 4, and vertical legs 6 and 7. In general, all four members of the frame are of hollow circular cross section. On the mooring support side 2, the leg 6, through top and bottom cylindrical joint segments 5, engages a slitted cylindrical member 8, which is fastened to support 2 and extends from top of the support to a depth required by submergence of the dock pontoon 1, and provides a track for sliding engagement of joint segments 5 of the frame.

Figure 1A:
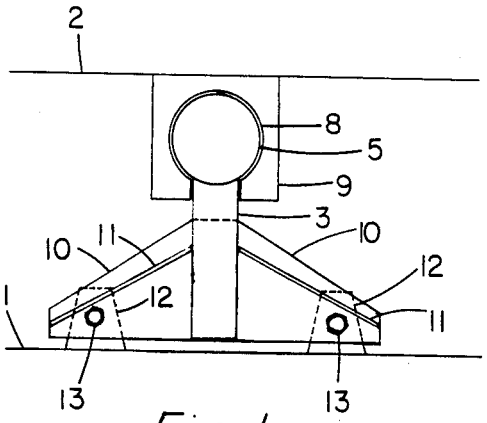
FIG. 1*a* is a top view of the framing assembly.
Figure 1C:
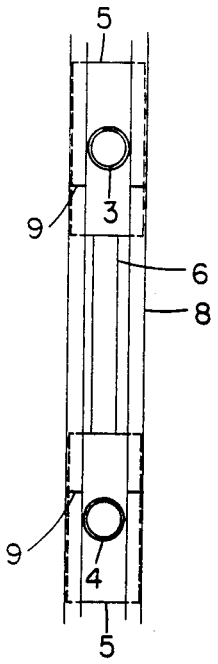
FIG. 1*c* is a cross section view of track 8.
Figure 1B:
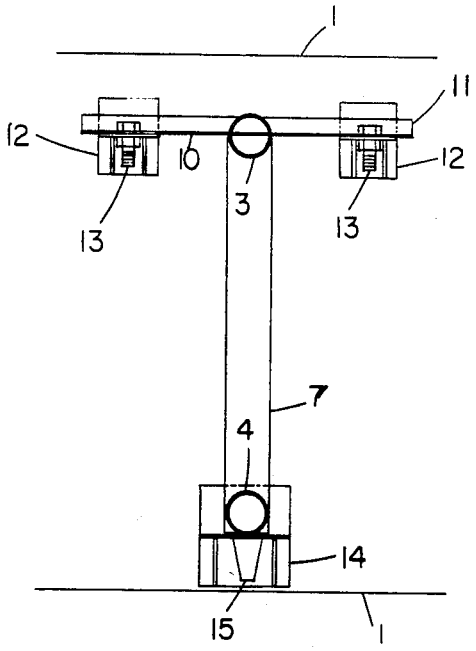
FIG. 1*b* is a cross section view of leg 7.

On the dock pontoon 1 side, the frame 16 is connected to the pontoon through pins engaging holes in three brackets rigidly attached to the inboard face of the pontoon 1. The details of the arrangement are indicated in FIGS. 1, 1*a* and 1*b*. In FIG. 1*a*, which is a top view of the frame 16, the upper arm 3 is shown with a piercing welded gusset plate 10 at mid-height, reinforced with stiffeners 11, and contains holes for two pin connectors 13, to attach the arm 3 to corresponding two upper brackets 12 on the pontoon 1. The lower arm 4 connection is shown in FIG. 1*b*, which is a vertical cross section of the frame 16, looking towards the pontoon 1. There the leg 7 is framed to arm 4, from bottom of which a projecting tapered pin 15 engages a tapered hole in a bracket 14 fastened to the pontoon 1. The three-point connection thus proviced enables the frame 16 to receive from the pontoon 1 and transmit through arms 3 and 4 to engaging track 8 shear and twist forces caused by longitudinal or end wind yaw, as well as shear and bending due to transverse wind and water current. The cylindrical slitted track 8, reinforced with stiffeners 9, is rigidly fastened to mooring support structure 2. FIG. 1*c*, which is a vertical cross-section of the frame 16, looking towards the support structure 2, shows the vertical slit in the track 8.

The connection arrangement of the frame 16 is designed for ease of installation and removal. To install it, first, the bottom joint segment 5 of the frame 16 is inserted into track 8 from the top. Then, after pulling pontoon 1 closer, the frame 16 is lowered into place by engaging the hole in lower bracket 14 through the tapered pin 15. Next, the holes in upper arm gusset 10 are aligned with corresponding holes in upper two brackets 12 and the threaded pins 13 are inserted and secured by locking nuts. Removal of the frame is accomplished by simply removing the two pins 13 and raising the frame.

Figure 2:
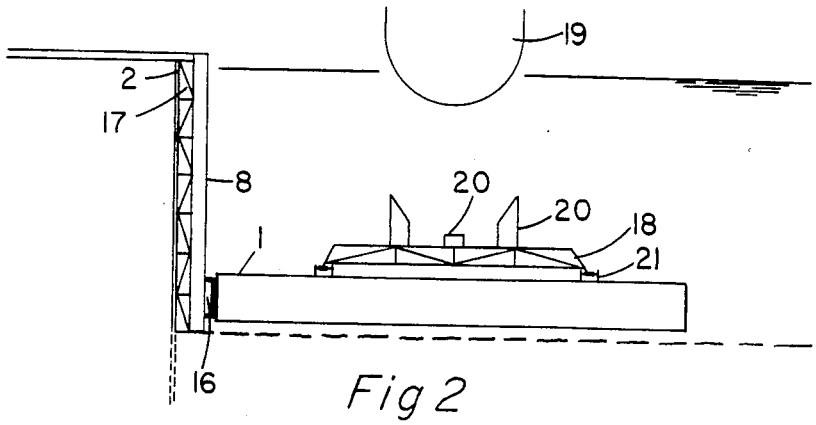
FIGS. 2, 3 and 4 schematically show a vessel being docked and shore transferred.
Figure 3:
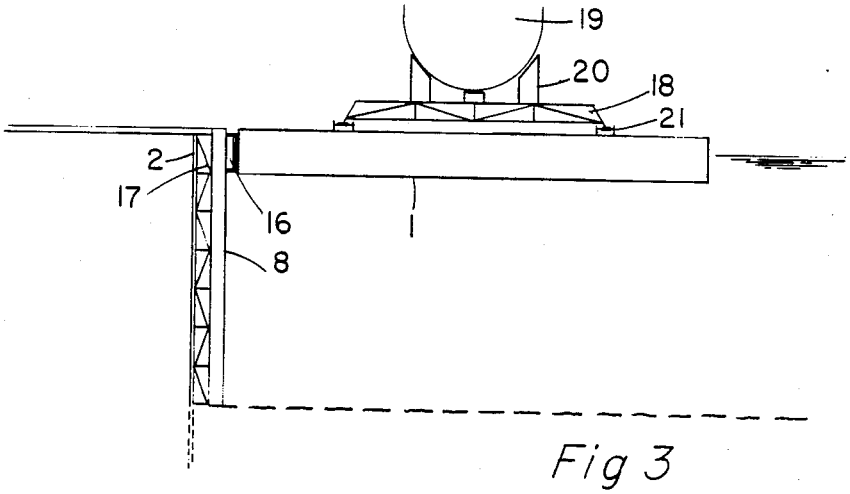
Figure 4:
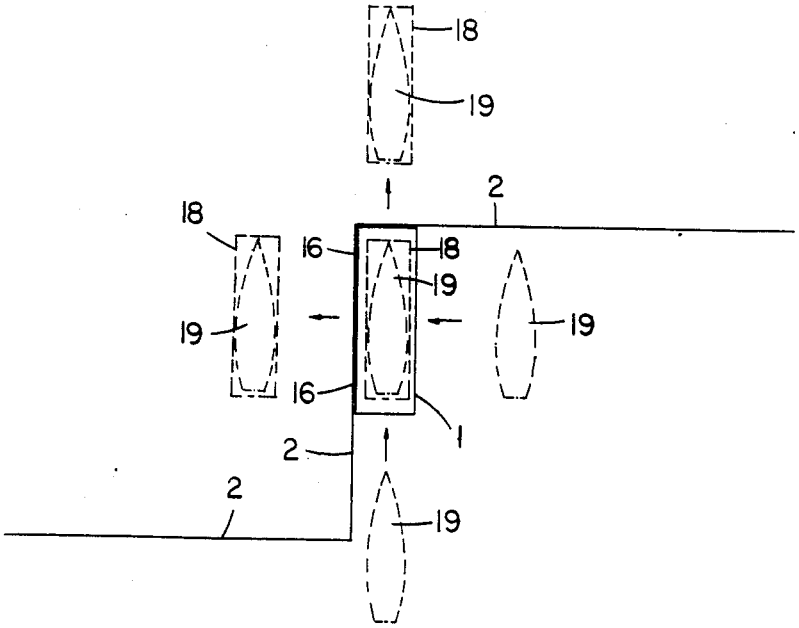

The advantages obtainable by the use of the Stabilizer are many and vary according to the function of the structure to which it is attached. Functionally, the submersible pontoon—used as a floating dry dock, is, of course, the most important application contemplated by the invention. This particular use of the Stabilizer is shown schematically in FIGS. 2, 3 and 4, where a vessel is docked and shore transferred. FIG. 4 is a plan view of the site of operation. It consists of a corner of a slip or basin, enclosed by bulkheads 2, and, where the dock pontoon 1 is held in place through two Stabilizers 16. A vessel 19 is brought into the basin and maneuvered into one of two alternative positions for docking it on the pontoon 1; one for access from the end, and the other from the side. FIG. 2 is a cross-section of the basin, showing the dock 1 lowered to the bottom, with the Stabilizer 16 engaged in the vertical guidance track 8 and its support truss 17 anchored to bulkhead 2, and the vessel 19 positioned for contact and pick-up on docking blocks 20, prior to start of the lift. FIG. 3 shows the pontoon 1 elevated, by removing its water ballast through application of compressed air, to bring the top deck in levelment with adjacent bulkheads 2 deck pavements, at which time, the transfer carriage 18, mounted on swivel rollers or wheels 21, is released for shore transfer of the vessel 19. As explained above and indicated in FIG. 4, the transfer can be made endwise or sideway.

Figure 5:
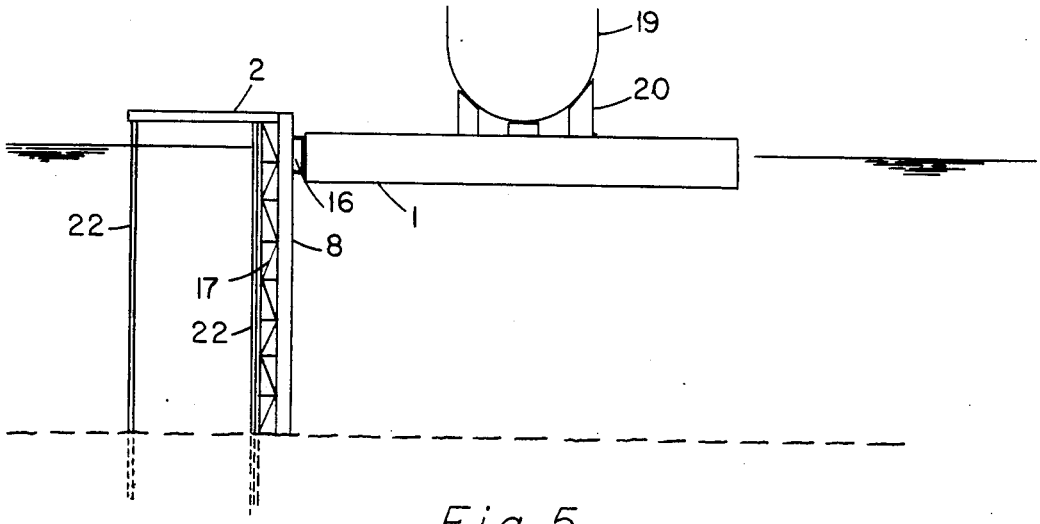
FIG. 5 shows the stabilizer 16 on a service pier.
Figure 6:
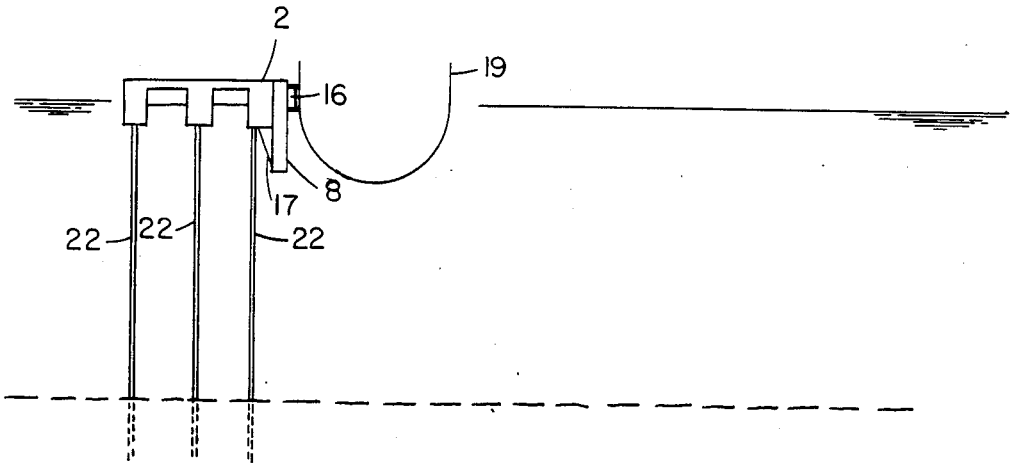
FIG. 6 shows the stabilizer used alone for mooring.

It is especially to be noted that, during the full cycle of drydocking, that is, docking a ship on the pontoon, rendering the needed repair services in-place while the dock remains afloat, and then undocking or lowering it back into water, the dock remains laterally motionless, and thus a level deck is maintained at all times. This favorable condition, further enhanced by the absence of restrictive deck obstructions—such as wing walls in a conventional floating dry dock, would make in-place repair work both desirable and advantageous. In this case, the transfer carriage 18 is eliminated, and docking blocks 20 are placed directly on the pontoon deck.

Where a shore transfer is not contemplated, and a service pier is available, both docking and repairs to ship may be rendered at a pier. FIG. 5 depicts such a case. Here track 8 of Stabilizer 16 is supported on a vertical truss 17 which, in turn, is fastened at the top to deck framing of pier 2 and at the bottom to additional foundation piling 22. This also illustrates the dual function of a single berth—serving both as a docking and mooring site. However, if the berth is to be used for mooring alone, a simplified support arrangement, such as one shown in FIG. 6 can be utilized. Of course, this is the general case of rigid mooring, provided by the Stabilizer 16 to vessel 19. Here the track 8 is attached directly and through bracket 17 to longitudinal pier girder 2, with a height sufficient to allow for tidal rise and fall.

In some other applications, the Stabilizer would be used to improve the efficiency and to lower the maintenance cost of an existing facility. A good example of this case is presented by the conventional floating dry dock. By eliminating the wing walls and installing Stabilizers, and also replacing mechanical pumps with compressed air, the old dock would be converted into a simple yet most advantageous lift dock—rendering many drydocking services not obtainable in the old system.

Aside drydocking facilities, the Stabilizer can also be utilized in ocean-bed exploratory structures, in the form of oil drilling platforms, and equipment and materials transfer shuttles to great depths—unpenetrated heretofore. In fact, this may well constitute the most exciting field of application for the Stabilizer.

The details and arrangement of the stabilizer frame shown in FIG. 1*a*, 1*b* and 1*c* and described above constitute the full basic concept of this invention. While a number of variations, either in arrangement or detail, can be introduced in a particular application, it will be understood that such modifications may be made without departing from the intent and spirit of the invention. For example, in the arrangement shown, all stabilizer frames 16 are assumed to be alike, and placed in paralleling vertical planes normal to the longitudinal axis of lateral support structure 2. In certain applications requiring greater longitudinal rigidity than that provided by two-bracket 12 connection of upper arm 3 in FIG. 1*a*, some of the frames 16 may be placed in vertical planes inclined to the longitudinal axis. Also, while in the basic arrangement the frames 16 are not interconnected to simplify their placement and connection problem, in a particular case, the designer may choose to brace them laterally in pairs. Changes may also be introduced in connection details, provided that such alterations are made to further simplify the attachment and detachment problem. With respect to this consideration, in some instances, the use of suction-type, vacuum-pad connections may be found as advantageous substitution for the sketched details. Improvements may also be made in the vertical guide track 8 by providing roller-bearing liners to further minimize frictional binding during vertical movements. Also, the lengths of arms 3 and the heights of legs 6 and 7 may vary to fit the contour and profile of the floating structure to which the stabilizer frames 16 are to be attached. In some of such cases, the needed variation may be made through the use of splice sleeves adjustable at the site of installation.

Having thus described my invention and given its principal uses or applications, I claim:

1. A stabilizer system for mooring a floating or submersible structure to a fixed support structure and for laterally immobilizing said moored floating or submersible structure, said system comprising a plurality of rigid frame units composed of tubular members with readily detachable connections, said frame units comprising a first side having an upper and a lower attachment to said floating or submersible structure, and a second side having an upper cylindrical joint piece and a lower cylindrical joint piece, and a leg member rigidly connecting said upper cylindrical joint to said lower cylindrical joint, said upper cylindrical joint piece having a first arm extending horizontally towards said upper attachment, said lower cylindrical joint piece having a second arm extending horizontally towards said lower attachment, said fixed support structure having a slitted cylindrical vertical track for engaging said cylindrical joint pieces and for providing guidance to vertical movements and restraint against rotational and lateral movements of said floating or submersible structure.

2. A stabilizer system according to claim 1 whereby said system moors a compartmented pontoon forming a wingless floating dry dock.

3. A stabilizer system according to claim 1 whereby an existing floating dry dock with wing walls is converted into a wingless floating dry dock, said conversion being made by separating the wing walls from the pontoon of said existing floating dry dock.

4. A stabilizer system according to claim 1 whereby said system moors a floating ship to a fixed support structure providing a stabilized mooring.

* * * * *